US005791564A

United States Patent [19]

Carra

[11] Patent Number: 5,791,564

[45] Date of Patent: Aug. 11, 1998

[54] LANCE FOR HIGH-PRESSURE WASH DEVICES

[75] Inventor: Riccardo Carra, Modena, Italy

[73] Assignee: Annovi E Reverberi S.P.A., Modena, Italy

[21] Appl. No.: 745,040

[22] Filed: Nov. 7, 1996

[30] Foreign Application Priority Data

Nov. 7, 1995 [IT] Italy ..... RE950056 U

[51] Int. Cl.[6] ..... B05B 9/01

[52] U.S. Cl. ..... 239/526; 239/583

[58] Field of Search ..... 239/526, 525, 239/583, 578, 531

[56] References Cited

U.S. PATENT DOCUMENTS 4,083,497 4/1978 Rosenberger ..... 239/526

4,776,517 10/1988 Heren ..... 239/526 X 5,143,299 9/1992 Simonetti et al. ..... 239/526

5,176,327 1/1993 Peterson et al. ..... 239/526

5,323,968 6/1994 Kingston et al. ..... 239/526 X

FOREIGN PATENT DOCUMENTS 9004299 9/1990 Germany .

*Primary Examiner*—Lesley D. Morris

[57] ABSTRACT

A delivery lance which includes a pistol handgrip formed in one piece with a delivery tube, at the base of which is provided a valve seat for a valve which opens and closes the lance. The pistol handgrip is internally hollow and closed by a side cover which, together with the handgrip, provides access to the articulation, support and guide elements for a pressurized water feed tube, for a valve body telescopically mounted at the tube end, for an operating lever or trigger causing the valve body to undergo translational movements against a spring, and for a locking device for the lance operating lever or trigger.

1 Claim, 4 Drawing Sheets

17
18
13
11
14
16

VI
VI
121
18
111
130
13
14
11
142
143
147
145
21
15
16
12

LANCE FOR HIGH-PRESSURE WASH DEVICES

BACKGROUND AND SUMMARY OF THE INVENTION

The increasing distribution of high-pressure wash devices, especially in semi-professional versions for private use, has made it desirable to adopt innovative constructional criteria by which greater constructional simplicity can be combined with high strength and ease of maintenance.

The reason for this is to both achieve better management of the spares stock and to enable repairs to be carried out by less expert persons.

The above requirements, which apply to all the components of wash devices, are particularly felt in the case of the delivery lance.

The present application provides a delivery lance for wash devices which satisfies the aforesaid requirements within the framework of a simple and reliable construction.

A typical characteristic of the present invention is the fact that the lance consists substantially of a single integral piece which comprises both the pistol handgrip and at least the first part of the delivery tube, and preferably the entire delivery tube as far as the end of the nozzle.

The single integral piece which, according to the present invention, forms the delivery lance also contains the valve seats and the articulation and guide means for the valve means, and respective operating means.

A cover laterally closes the pistol handgrip and provides access to the interior of the latter for mounting the few movable and fixed parts required for the operation of the lance.

The figures of the accompanying drawings clarify the constructional and operational merits of the invention, these being independent of its aesthetic form, as will be apparent hereinafter.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
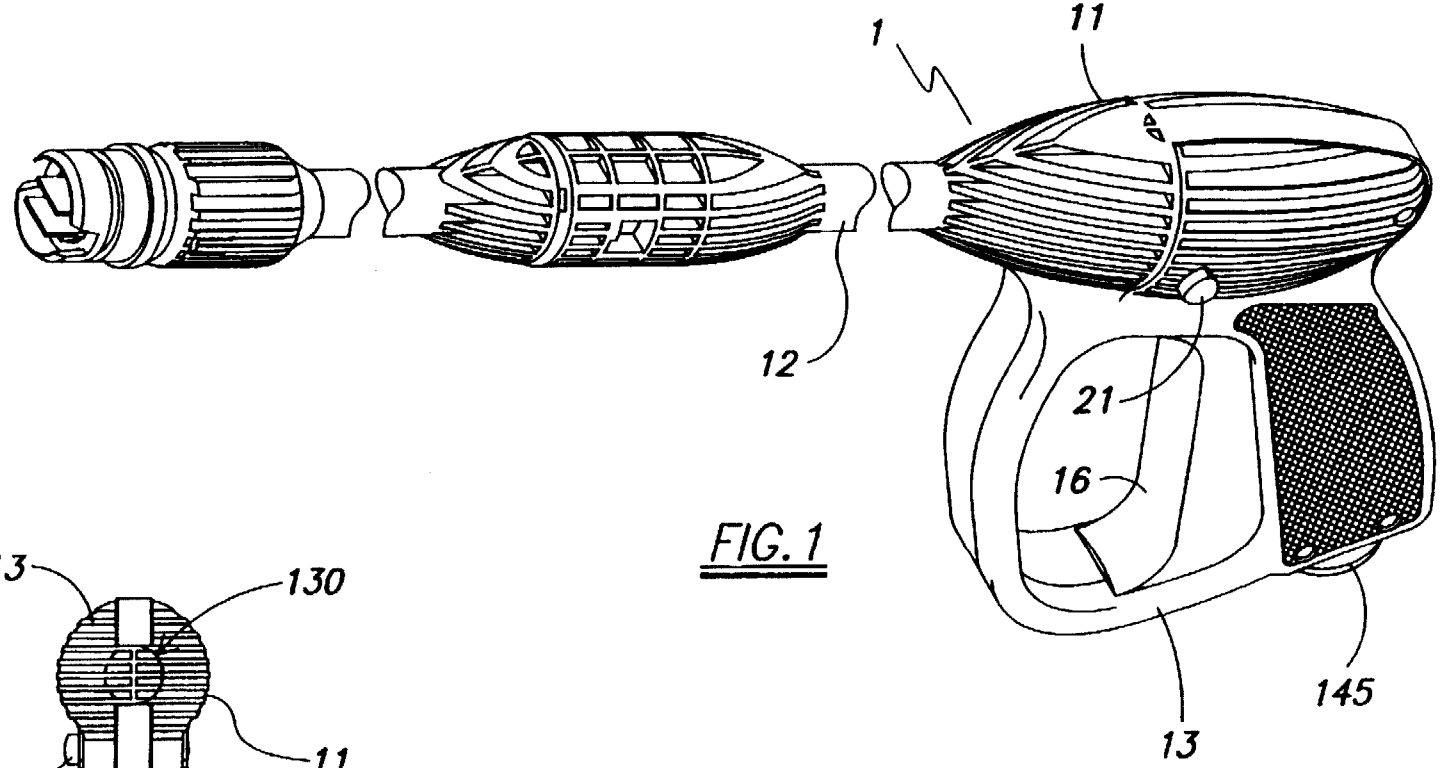
FIG. 1 is a perspective view of the invention.
Figure 3:
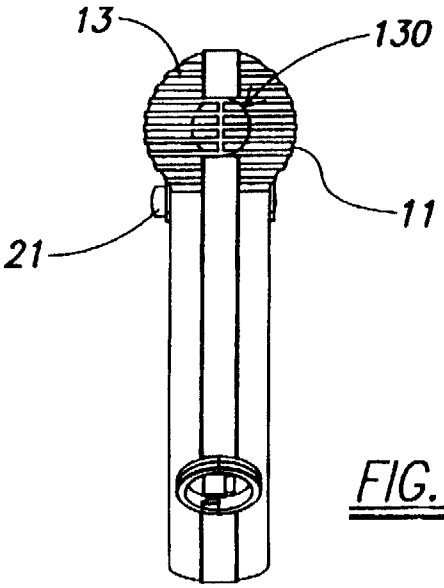
FIG. 3 shows the same view from behind.
Figure 2:
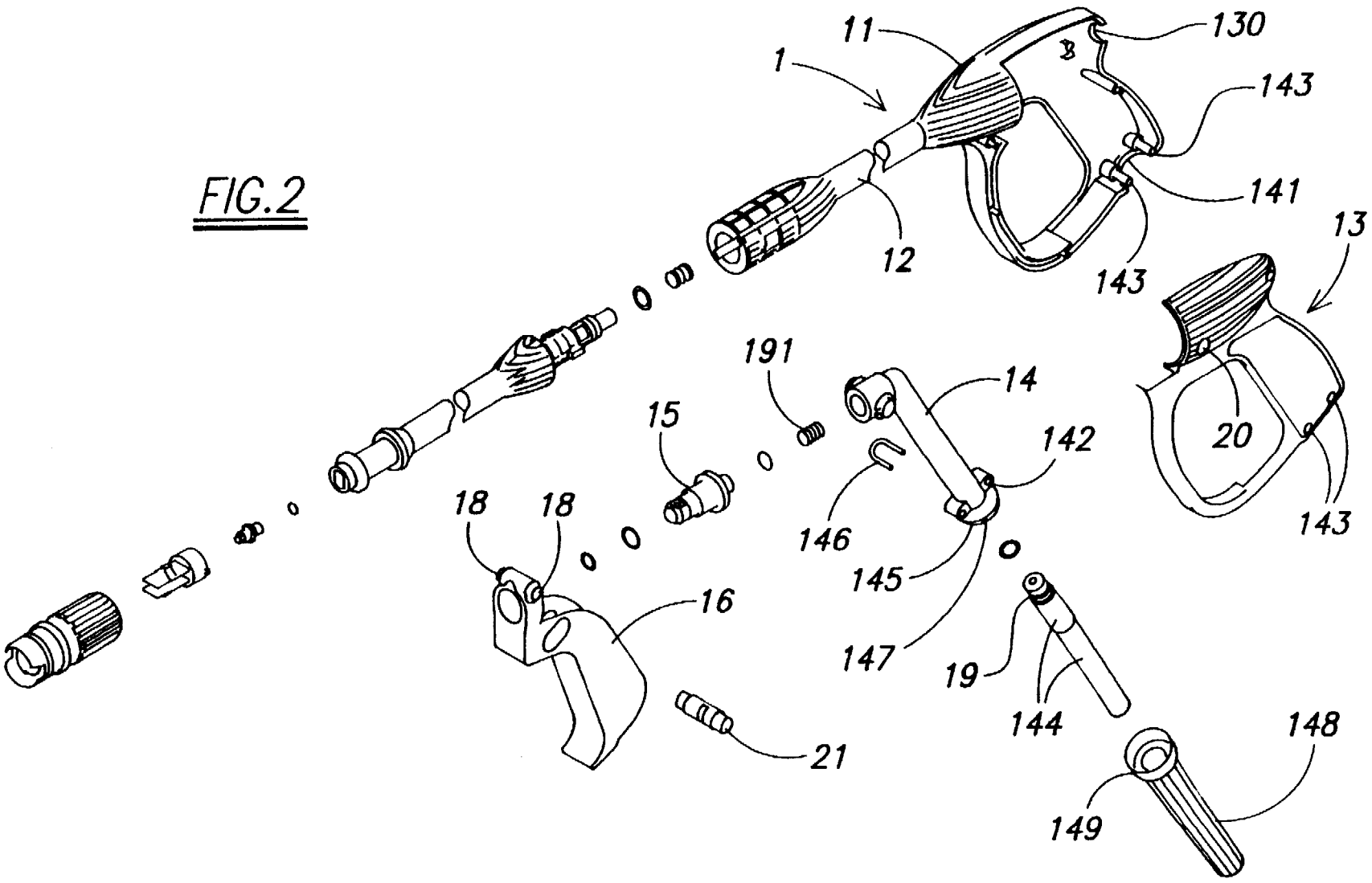
FIG. 2 is an exploded view of the invention.
Figure 6:
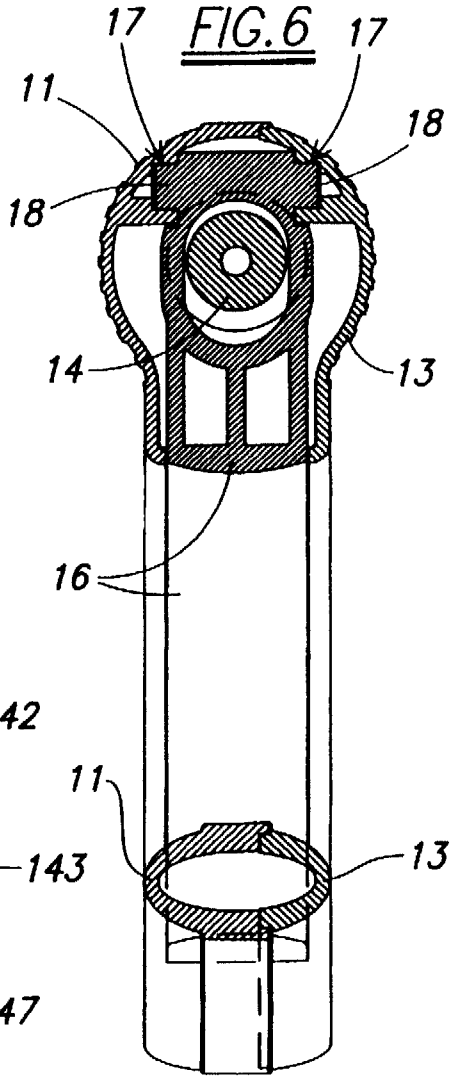
FIG. 6 is a section on the line VI—VI of FIG. 4.

FIG. 1 shows a structure 1 formed by injection molding with a suitable synthetic material, and comprises a hollow handgrip 11 and a tube 12 extending therefrom. According to the present invention, at least the initial part of the tube 12 is integral with the handgrip 11, as shown in FIG. 2. However, it is preferable for the entire tube 12 to be integral with the handgrip 11, as shown in FIG. 1.

The hollow handgrip 11 can be closed laterally by a cover 13 and maintained in position by a series of screws, not shown, which screw into the seats 111 provided in the handgrip.

Within the cavity defined by the handgrip 11 and the cover 13 there are located the pressurized water feed tube 14, a valve body 15 and an operating lever or trigger 16.

With reference to FIGS. 4 to 7, it can be seen that the handgrip and the relative lateral cover 13 comprise two opposing adjacent seats 17 receiving two coaxial cylindrical raised portions 18 projecting from the lever or trigger 16, which is hence constrained to rotate about their axis.

Figure 4:
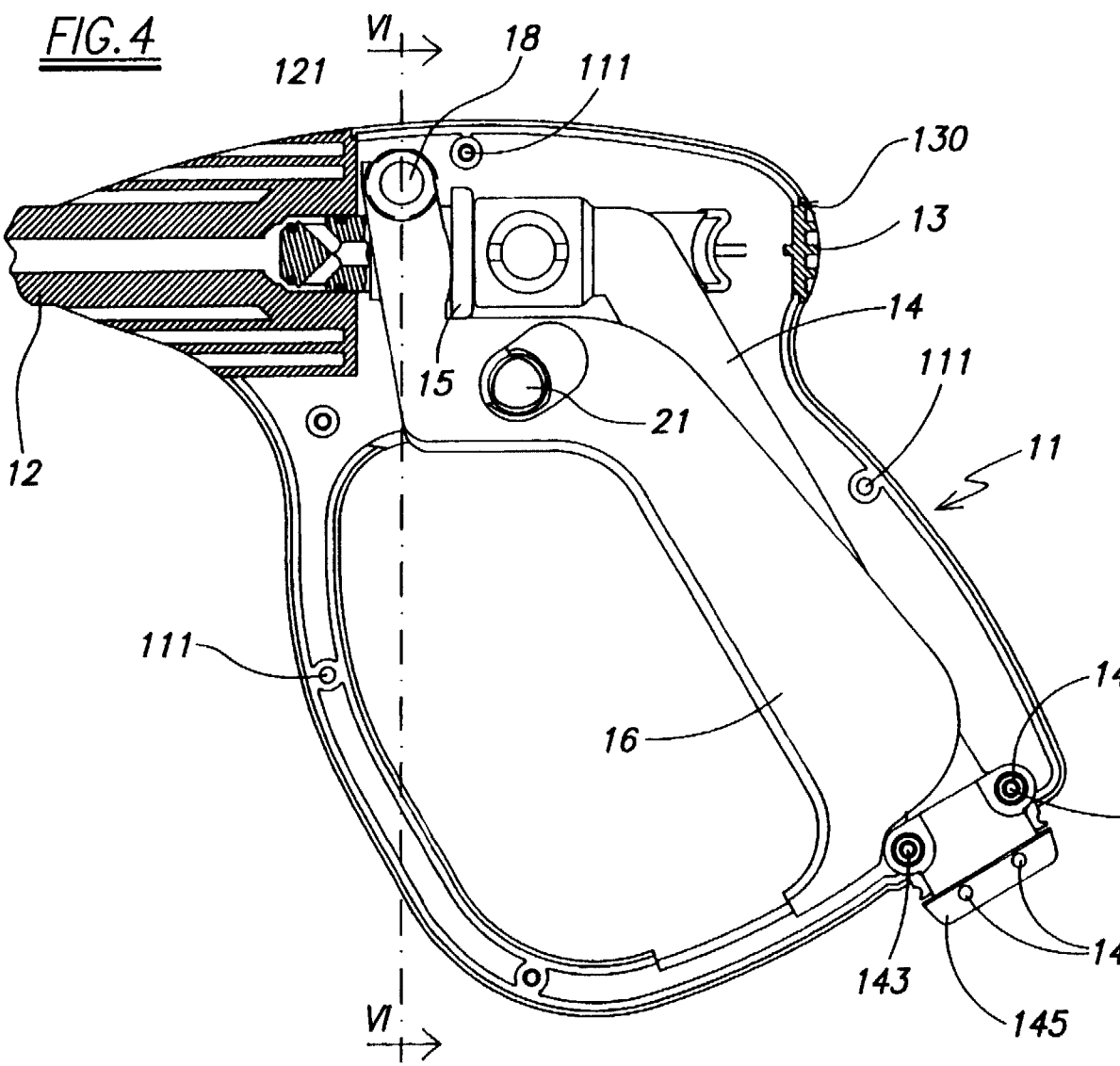
FIG. 4 is a partly sectional view of the pistol handgrip in its open state.

Below the axis, the lever 16 is traversed by the valve body 15 which is operated by the lever or trigger 16 between two positions, namely a closed position (shown in FIG. 5) and an open position (shown in FIG. 4).

Figures 5, 7:
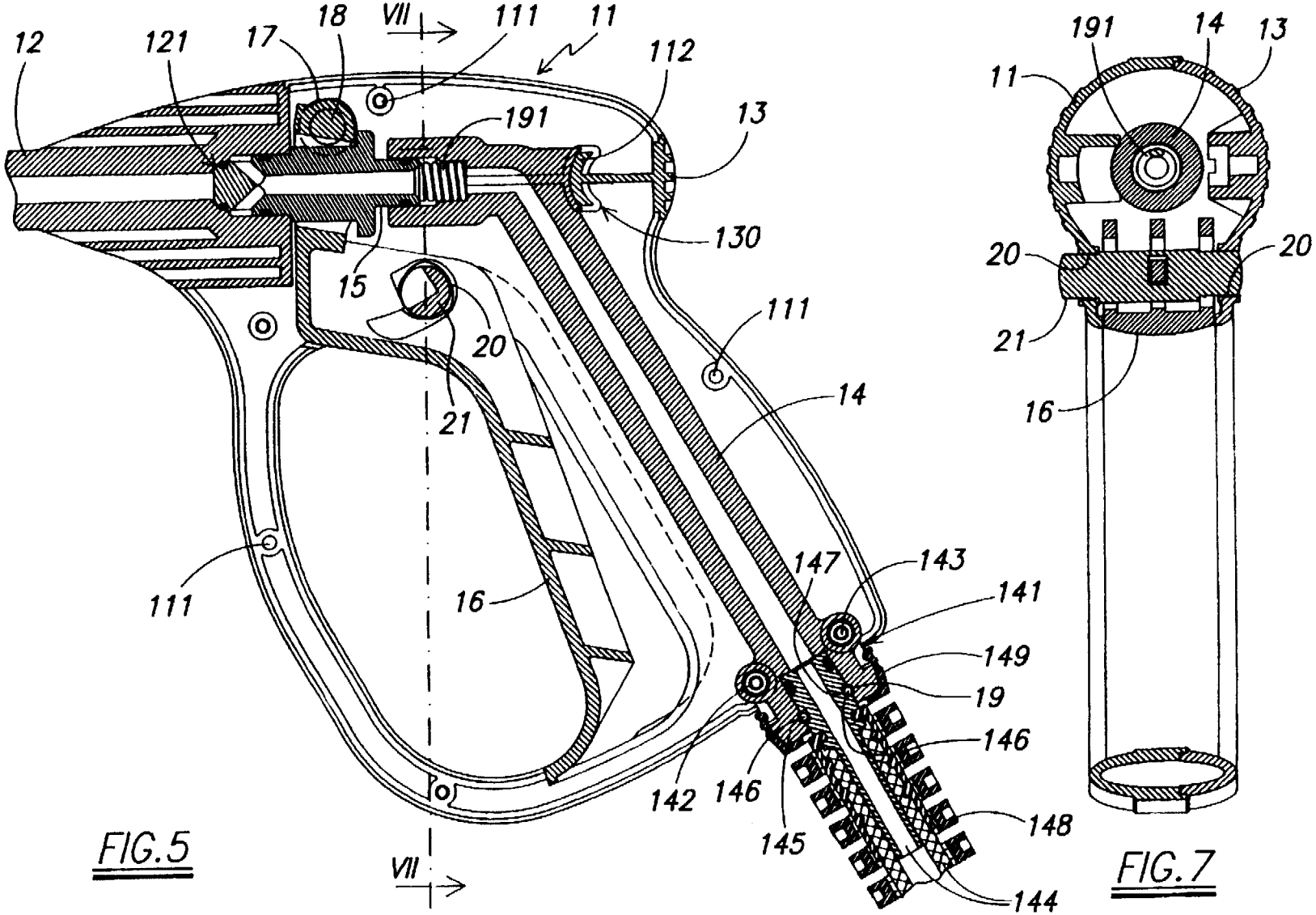
FIG. 5 is an axial section through the pistol handgrip.
FIG. 7 is a section on the line VII—VII of FIG. 5.

More specifically, as shown in FIG. 5, the valve body 15 is mounted telescopically at the end of the water feed tube 14 by way of a spring 191, and engages in the valve seat 121 provided at the end of the tube 12.

A detailed description of the annular seal gaskets is omitted, since these are of the usual type and can be easily identified from the figures.

The tube 14 comprises a base 145 which is laterally inserted as an exact fit into the recess 141 in the wall of the handgrip, and include two parallel holes 142 which engage with two pins 143 and is rigid with the fixed side wall of the handgrip.

The tube 14 is maintained in position by the cover 13, and partially emerges at its base 145 from the handgrip to receive a feed hose 144.

The end of the hose 144 is locked to the tube 14 by a U-shaped piece 146 (see FIG. 2) which is inserted through two holes 147 provided in the base 145 and into an annular cavity 19 present in the end of the tube 144 (see FIG. 5).

About the initial portion of the hose 144 there is mounted an elastic sheath 148, for protection against excessive creasing, which terminates in a cap 149 elastically mounted on the base 145.

The cap 149 also maintains the U-shaped piece 146 in position.

The top of the tube 14 is maintained in position by a rear counteracting member 112 branching from an appendix of the cover 13 and received in a corresponding recess 130 in the handgrip 11 (see FIG. 5).

The cover 13 and handgrip 11 comprise two facing coaxial seats 20 for receiving therein a sliding pin 21 which can assume a position such as that shown in FIG. 7 in which it allows the trigger 16 to be operated, and a position to the right of that shown, in which it blocks the operation of the trigger.

All the objects of the invention are attained by virtue of the aforedescribed innovations.

The component assembly is extremely simple, and does not require special tools. In fact, the number of its component parts is extremely small, allowing economical and easy stocking. Also, its weight is very low and its mass production cost is extremely modest.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A delivery lance for a high-pressure washing device which comprises a pistol handgrip and a delivery tube, said pistol handgrip being formed in one piece with the delivery tube, said pistol handgrip being internally hollow and being closed by a side cover which, together with said handgrip, provides access to the interior thereof, a pressurized water feed tube disposed in the interior of the handgrip, said pressurized water feed tube having an upstream end and a downstream end, said upstream end connecting with a feed hose, a valve seat disposed in an upstream end of the delivery tube at a distance from the downstream end of the water feed tube, a valve body mounted on a spring and adapted to engage the valve seat for opening and closing the water stream of the water feed tube, said valve body being biased by said spring in a closed position being telescopically mounted between the downstream end of the feed tube and the upstream end of the delivery tube for making a connection for the water stream between the feed tube and the delivery tube, and an operating lever or trigger, articulated inside the handgrip for causing said valve body to undergo a translational movement against the bias of the spring.

* * * * *